US008393020B2

(12) United States Patent
Grant

(10) Patent No.: US 8,393,020 B2
(45) Date of Patent: Mar. 12, 2013

(54) BATH AND SHOWER SUPPORT SYSTEM

(76) Inventor: Willie T. Grant, Birmingham, AL (US)

( * ) Notice: Subject to any disclaimer, the term of this patent is extended or adjusted under 35 U.S.C. 154(b) by 350 days.

(21) Appl. No.: 12/755,205

(22) Filed: Apr. 6, 2010

(65) Prior Publication Data

US 2011/0239365 A1 Oct. 6, 2011

(51) Int. Cl.
*A47K 3/024* (2006.01)

(52) U.S. Cl. ..... 4/576.1; 211/88.04; 211/123; 211/175; 211/105.1; 16/436; 248/206.3; 248/363

(58) Field of Classification Search ..... 4/576.1, 4/571.1, 572.1, 573.1, 577.1, 579; 248/206.3, 248/205.7, 309.3, 363; 211/88.04, 123, 175, 211/105.1; 16/436, 438
See application file for complete search history.

(56) References Cited

U.S. PATENT DOCUMENTS

| | | | | |
|---|---|---|---|---|
| 2,243,794 | A * | 5/1941 | Dunn | 4/576.1 |
| 2,815,513 | A * | 12/1957 | Tilson et al. | 4/576.1 |
| 3,568,220 | A * | 3/1971 | Dees | 4/576.1 |
| 4,498,204 | A * | 2/1985 | Warner | 4/559 |
| 4,944,478 | A * | 7/1990 | Sullivan | 248/205.7 |
| 6,371,423 | B1 * | 4/2002 | Miller | 211/123 |
| 7,877,824 | B2 * | 2/2011 | Grant et al. | 4/576.1 |
| 2005/0160526 | A1 * | 7/2005 | Korn | 4/577.1 |
| 2006/0053547 | A1 * | 3/2006 | Farrow et al. | 4/576.1 |
| 2007/0086852 | A1 * | 4/2007 | Goad | 403/292 |
| 2007/0130682 | A1 * | 6/2007 | Farrow | 4/576.1 |
| 2008/0222790 | A1 * | 9/2008 | Grant | 4/576.1 |

* cited by examiner

*Primary Examiner* — Gregory Huson
*Assistant Examiner* — Janie Christiansen

(57) ABSTRACT

Bath and shower support systems for a bath or shower enclosure have adjustable grab bars bearing on adjustable lower supports and laterally connecting to a parallel tiled wall by suction cups clamped to the tile by locking means. An adjustable length upward extending grab bar attaches to the lower grab bar with its upper extremity attaching to the tiled wall by connection means that includes a suction cup.

2 Claims, 4 Drawing Sheets

BATH AND SHOWER SUPPORT SYSTEM

BACKGROUND OF THE INVENTION

Patent application Ser. No. 11/684,661 presents BATH AND SHOWER ASSIST MEANS for installation in a bath or shower enclosure. A horizontal rotatable grip bar spans between two parallel walls perpendicular to the longitudinal axis of the bar. Compressible means attached to each end of the bar grip the walls when the bar is rotated to apply a longitudinal force to the compressible means. At intermediate locations along the length of the bar tension members, namely suction cups, connect the bar to a wall parallel to its longitudinal axis. In addition, at intermediate locations along the length of the bar vertical supports extend from the grip bar down to the rim of a bathtub or to the floor of a shower enclosure The system exceeds the strength requirements and fulfills other requirements of ASTM 446-85 (2004), the specification for testing grab bars, and also meets the requirements of building codes. However, it lacks the means to have a significantly adjustable length grip bar or to significantly adjust the height of the vertical supports above a base support. These shortcomings of the grip bar and vertical supports requires that each installation be made according to specific user requirements and dimensions. It is preferred, therefore, to have lateral support means that provide for a significantly adjustable length grab bar and adjustable height supports that fulfill the needs and requirements of varied users in a single product and accommodate variations in the dimensions and spacing of wall tiles as well.

SUMMARY OF THE INVENTION

The present invention fulfills these requirements and provides other advantages for general installations and user requirements.

One of the objectives of the present invention is to provide a grab bar having adjustable means permitting the supported length of the bar to be adjusted.

Another objective is to provide lower supports having adjustable means permitting the grab bar to be raised or lowered as required by user and for installation purposes.

Another objective is to provide means to clamp and secure the suction cups of the connection means in the installed compression mode.

Another objective is to provide motion inhibiting means to prevent rotation and translation of the grab bar relative to its supports.

Another objective is to provide an upward extending grab bar as an integral part the installation.

These and other objects and advantages of the invention will become apparent after considering the following detailed specification and accompanying drawings which cover a preferred embodiment wherein:

DETAILED DESCRIPTION OF A PREFERRED EMBODIMENT

Figure 1:
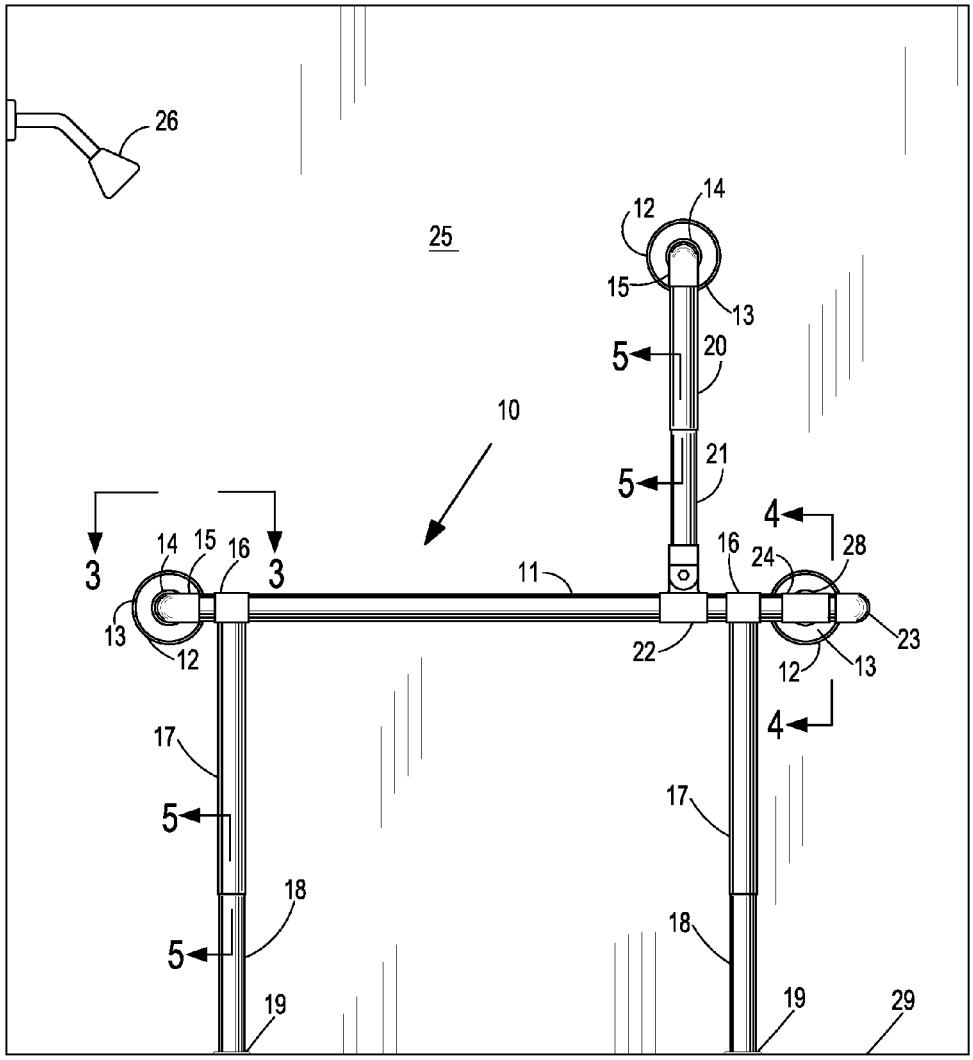
FIG. 1 is an elevation view of a first bath and shower support system installed in a tub or shower enclosure.

Referring to the views, FIG. 1 shows first bath and shower support system 10 according to the present invention for installation in a bath or shower enclosure and attaching to a tiled wall 25 parallel to first grab bar 11. FIG. 1 also shows shower head 26 and base support means 29, which is the rim of a bathtub or the floor of a shower stall depending on the location of the installation.

Figure 3:
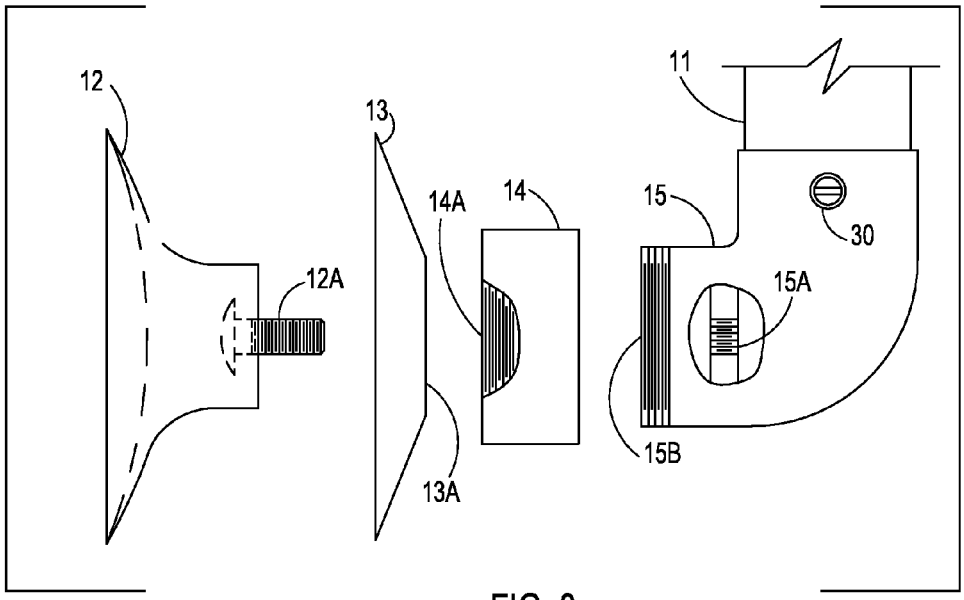
FIG. 3 is an exploded view taken along line 3-3 in FIG. 1 showing a first connection means and an el bracket.
Figure 4:
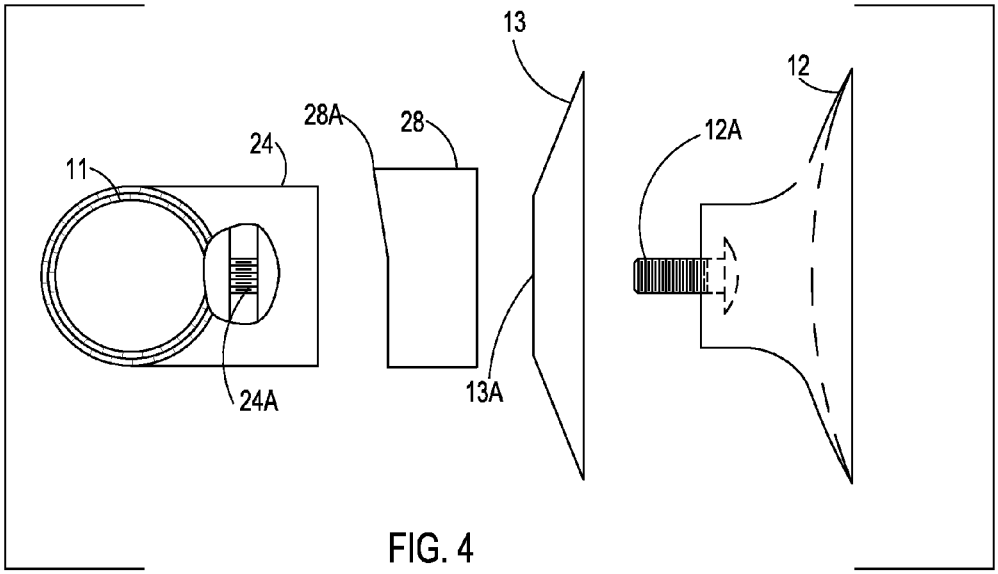
FIG. 4 is an exploded view taken along line 4-4 in FIG. 1 showing a second connection means and a tee bracket.

First bath and shower support system 10 of FIG. 1 comprise first grab bar means, lower support means, and upper means. First grab bar means includes first grab bar 11, first and second connection means as shown in FIGS. 3 and 4 respectively, and described below, and coupling and bracket means. Collectively said coupling and bracket means comprise sleeve brackets 16, coupling 22, tee bracket 24, el bracket 15, and closure fitting 23 shown in FIG. 1. Lower support means comprise first support section 18, second support section 17, rotatable means of FIG. 5, described below, and non-slip bearing pad 19. In FIG. 1 first upper section 21, rotatable means of FIG. 5, and second upper section 20 comprise upper means having second upper section 20 attaching to first connection means; and, together, comprise the upper grab bar attaching to first grab bar 11 through coupling 22 and tiled wall 25 through first connection means. Said coupling and bracket means participate in connecting first grab bar 11 to tiled wall 25, to lower support means, and to upper means.

Said coupling 22 comprises an open top segment retaining first upper section 21 of said upper means and a lower segment encircling first grab bar 11. The upper and lower segments of said coupling are rotatably connected to provide angular rotation to said upper grab bar, allowing said upper grab bar to function both as a vertical and a diagonal grab bar.

First grab bar 11 of FIG. 1 comprise a round tubular section shown engaged by coupling 22, tee bracket 24, and sleeve brackets 16 of said coupling and bracket means. One extremity of said first grab bar 11 engages el bracket 15 and first connection means, shown in detail in FIG. 3; and the opposite extremity engages second connection means of FIG. 4 and closure fitting 23 of coupling and bracket means of FIG. 1.

Referring to FIG. 3, first connection means includes suction cup 12 having threaded stud 12A, cover 13 having opening 13A, said cover conically shaped as the frustrum of a cone, first locking means 14 having internal threads 14A, all engaging el bracket 15; said el bracket comprised of a longitudinal segment having its axis concentric with longitudinal axis of said first grab bar and a segment tranverse to said longitudinal segment. Said el bracket 15 of coupling and bracket means has male threads 15B, and insert 15A with female threads compatible with male threads of stud 12A. First locking means 14 is installed on el bracket 15 with internal threads 14A of first locking means 14 engaging male threads 15B of el bracket 15. The base of suction cup 12 is inserted through opening 13A in cover 13 and through first locking means 14. Threaded stud 12A engages female threads of insert 15A of el bracket 15 with first locking means 14 encircling the transverse segment of el bracket 15. In the installation procedure, suction cup 12 is pressed firmly against tiled wall 25 followed by turning first locking means 14 until it bears forcefully against cover 13 causing the periphery of said cover to be pressed firmly against the periphery of suction cup 12 locking the suction cup in the compression mode.

Observing FIG. 4, second connection means comprises suction cup 12 with threaded stud 12A, cover 13 having opening 13A, said cover conically shaped as the frustrum of a cone, second locking means 28 having cam 28A on the circumference of said second locking means, and tee bracket 24. Said tee bracket comprises a longitudinal segment having its axis concentric with the longitudinal axis of first grab bar 11 and a segment tranverse to said longitudinal segment, having insert 24A with female threads compatible with external threads of stud 12A. Second locking means 28 is installed on the transverse segment of tee bracket 24 with cam 28A oriented to make contact with the longitudinal segment of tee bracket 24. The base of suction cup 12 is inserted through opening 13A in cover 13 and through second locking means 28, which encircles the transverse segment of tee bracket 24. Threaded stud 12A securely engages the female threads of insert 24A. Suction cup 12 is pressed firmly against tiled wall 25 followed by turning second locking means 28 until cam 28A engages the longitudinal segment of tee bracket 24 and second locking means 28 bears firmly against cover 13 causing the periphery of the cover to be pressed firmly against the periphery of suction cup 12 thereby locking the suction cup in its compression mode.

In FIG. 1 sleeve brackets 16 connect first grab bar 11 to the lower support means. Coupling 22, retaining the lower extremity of first upper section 21, connects upper means to first grab bar 11. In FIG. 4 tee bracket 24, having said opening transverse to its longitudinal axis, engages said second connection means. As a result of the continuous opening in the longitudinal segment of tee bracket 24, second connection means and said tee bracket can translate longitudinally along first grab bar 11, adjusting the laterally supported and usable length of said first grab bar. Further laterally supported and usable length adjustment can be achieved when el bracket 15 and first locking means 14 are replaced by tee bracket 24 and second locking means 28 to function as previously described. The translation of tee bracket 24 provides first grab bar 11 the capability to have a longer overall length than that defined by fixed locations of said connection means. Where laterally supported length adjustment of said first grab 11 is not essential, tee bracket 24 and second locking means 28 can be replaced by el bracket 15 and first locking means 14. Closure fitting 23 seals off the extremity of first grab bar 11.

FIG. 1 shows said lower support means positioned beneath first grab bar 11. Sleeve brackets 16 of said coupling and bracket means encircling first grab bar 11 have access openings containing the top extremities of second lower support sections 17. Said lower support sections, in combination with rotatable means shown in FIG. 5, provide vertical support and height adjustability to first grab bar 11.

Figure 5:
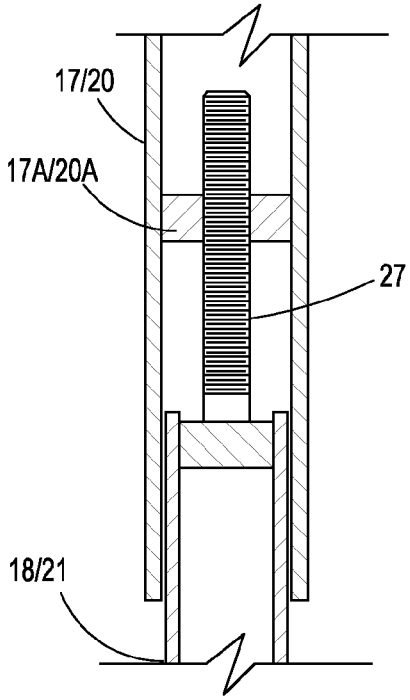
FIG. 5 is a sectional view taken along line 5-5 in FIG. 1 and FIG. 2 showing rotatable means.

FIG. 5 has numerical designations, e.g., (17/20) for both lower support sections and upper sections. The top number designates a lower support section and the bottom number an upper section. The top number is used in this present description. FIG. 5 shows the continuity of first lower support section 18, second lower support section 17, and rotatable means. Said rotatable means comprises female threaded insert 17A and male threaded means 27 secured in first and second lower support sections 18 and 17, respectively. This fixity permits first lower support section 18 to rotate male threaded means 27 in female threaded insert 17A translating first lower support section 18 axially; thereby adjusting the overall length of first and second lower support sections 18 and 17 as seen in FIG. 1. Where the wall thickness permits, aforesaid threads are incorporated into the walls of said first and second lower support sections.

When the user takes hold of first grab bar 11 in FIG. 1, the lower support sections transfer the vertical force component from said first grab bar to base support means 29. Non-slip bearing pad 19 attached to the lower extremity of first lower support section 18 prevents lateral movement of the lower support section on base support means 29.

Motion inhibiting means 30 shown on el bracket 15 in FIG. 3 rotates against said first grab bar 11 to inhibit rotation and translation of first grab bar 11 relative to el bracket 15. Additional motion inhibiting means is included within the inherent frictional resistance between first grab bar 11 and el bracket 15 when said first grab bar is inserted into the opening of said el bracket 15 developing a tight fit.

Bonding means is placed on the face of suction cup 12 and on the targeted tile on tiled wall 25 as an adhesive if the user should choose the option to make the installation "permanent".

Figure 2:
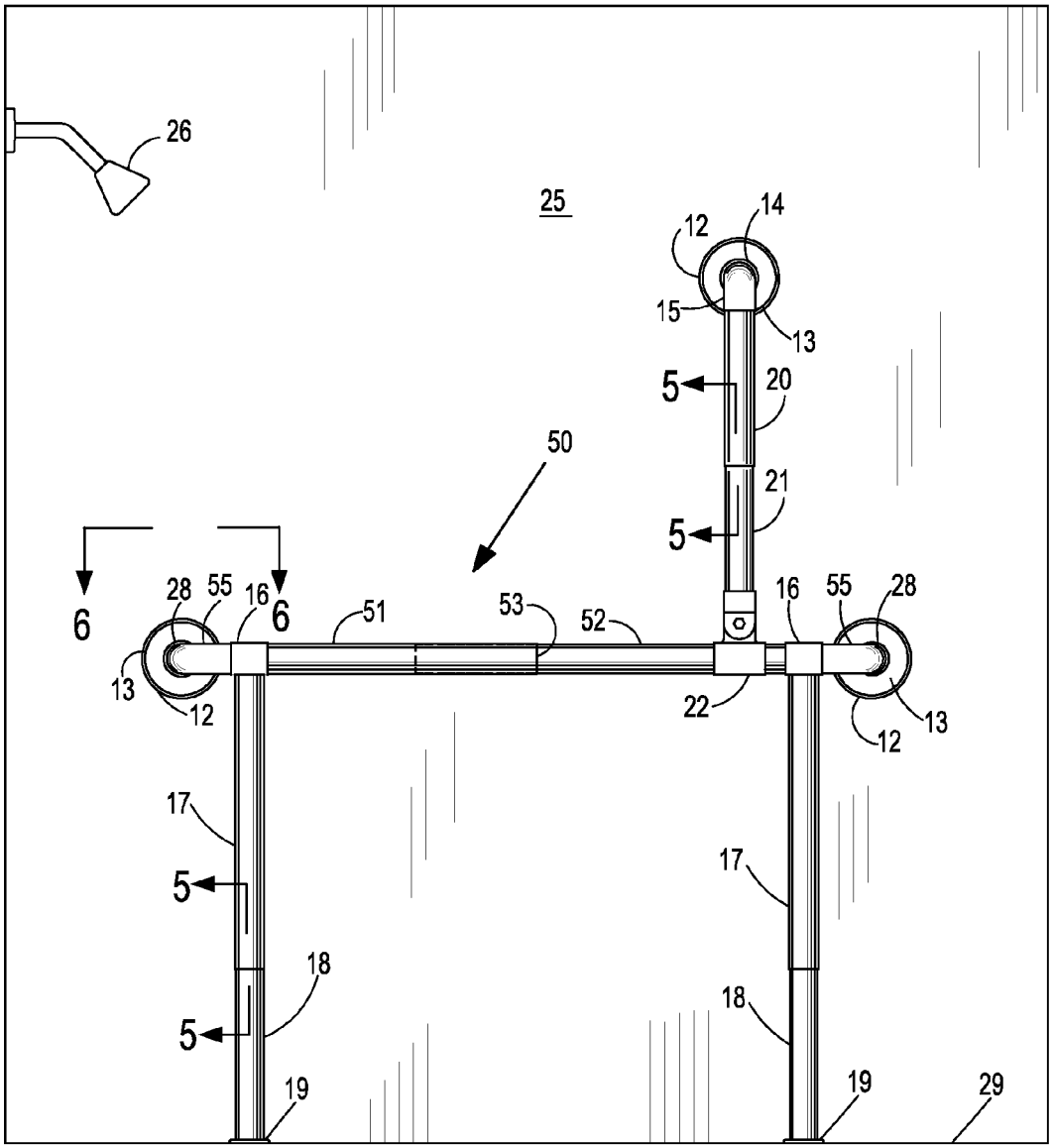
FIG. 2 is an elevation view of a second bath and shower support system installed in a tub or shower enclosure.

FIG. 2 shows second bath and shower support system 50 for installation in a bathtub or shower enclosure and attaching to a tiled wall 25 parallel to second grab bar. Bath and shower second support system comprise second grab bar means, lower support means, and upper means.

Second grab bar means comprise second grab bar having two sections, second connection means shown in FIG. 6 and described below, and aforesaid coupling and bracket means; said coupling and bracket means connecting said second grab bar to lower support means and upper means.

Said second grab bar of FIG. 2 comprises fixed section 51 and movable section 52; said movable section 52 translates longitudinally within fixed section 51 in telescopic manner. Entrance 53 of fixed section 51 accepts the intrusion of movable section 52. Both sections consist of round tubular shapes encircled by sleeve brackets 16 of said coupling and bracket means. Said coupling 22 is shown encircling movable section 52. An extremity of each of said sections has transverse segment 55 engaging second connection means shown in detail in FIG. 6.

Figure 6:
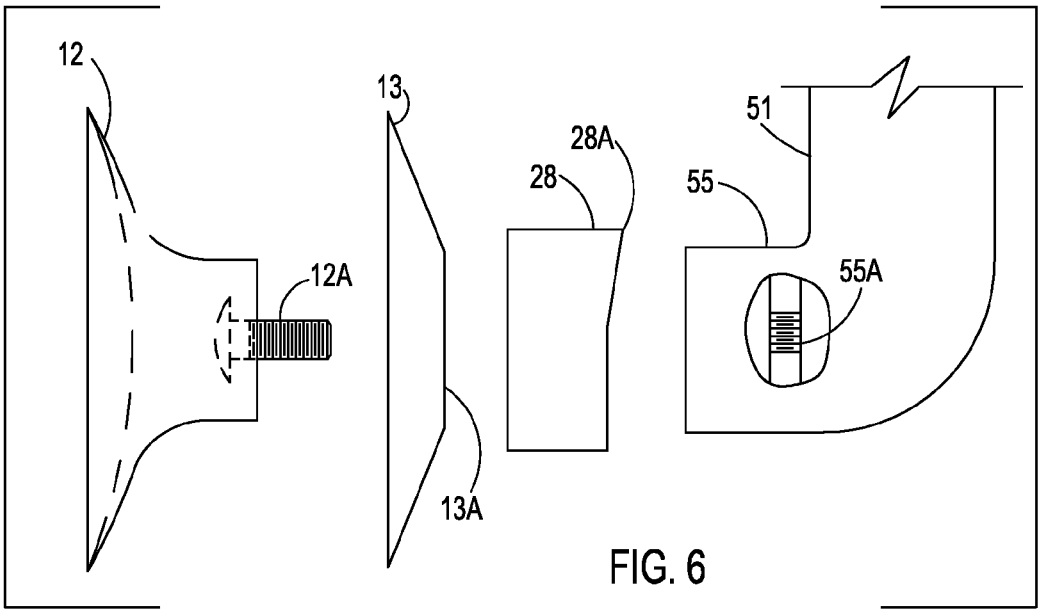
FIG. 6 is an exploded view taken along line 6-6 in FIG. 2 showing second connection means with a second grab bar with a transverse segment.

Referring to FIG. 6, second locking means 28 encircles said transverse segment 55 of fixed section 51. Cam 28A is oriented to make contact with the longitudinal leg of said fixed section 51. The base of suction cup 12 is inserted through opening 13A of cover 13 and through second locking means 28. Threaded stud 12A engages the female threads of insert 55A. Suction cup 12 is pressed firmly against tiled wall 25 followed by turning of second locking means 28 until cam 28A engages the longitudinal leg of fixed section 51. Second locking means 28 bears firmly against cover 13 causing the periphery of said cover to be pressed firmly against the periphery of suction cup 12, locking the suction cup in its compression mode when said cam is in its optimum orientation relative to longitudinal segment of fixed section 51. The description and operation for the extremity of movable section 52 is identical to that for fixed section 51 described above.

FIG. 2 shows lower support means, previously described, positioned beneath said fixed and movable sections of second grab bar. Sleeve brackets 16 of said coupling and bracket means encircling fixed section 51 and movable section 52, by means of access openings, contain the top extremities of second lower support sections 17; and in combination with first lower support sections 18 and rotatable means shown in FIG. 5, provide vertical support and height adjustability to said fixed and movable sections of second grab bar.

In FIG. 2 upper means comprise first upper section 21, rotatable means of FIG. 5, second upper section 20, engaging aforesaid first connection means; these components comprise aforesaid upper grab bar attaching to said second grab bar through coupling 22. Said coupling 22 functions in FIG. 2 as previously described for FIG. 1 to rotate said upper grab bar between a vertical and diagonal positions As previously described, FIG. 5 has numerical designations, e.g., (17/20) for both lower support sections and upper grab bar sections. The top number designates a lower support section and the bottom number an upper section. The bottom number is used in the present description. FIG. 5 shows the continuity among second upper section 20, rotatable means, and first upper section 21 of said upper grab bar; said rotatable means comprised of female threaded insert 20A and male threaded means 27. Said rotatable means are fixedly secured in first and second upper sections 21 and 20 respectively. This fixity permits first upper section 21 to rotate male threaded means 27 in female threaded insert 20A, translating first upper section 21 axially within second upper section 20 to adjust the overall length of said first and second upper sections in FIG. 2. Where wall thickness permits, aforesaid threads can be incorporated into the walls of said first and second upper sections.

When the user takes hold of said second grab bar in FIG. 2, said lower support sections transfer the vertical force component from said second grab bar to base support means 29 through non-slip bearing pad 19. Any horizontal force component is carried to tiled wall 25 through aforesaid connection means Bonding means is placed, as an adhesive, on the face of suction cup 12 and on the appropriate tiles on tiled wall 25 if the user chooses the option to make the installation "permanent".

It is preferred that the materials of construction for the preferred embodiment be rust and corrosion proof such as galvanized steel, stainless steel, plastic and rubber; each capable of providing the required characteristics for the specific use.

Thus there has been shown and described bath and shower support systems which fulfill all the objects and advantages sought after. Many changes modifications, variations and other uses and applications of the invention will, however, become apparent to those skilled in the art after considering this specification and accompanying drawings. All such changes, modifications, variations and other uses and applications which do not depart from the spirit and scope of the invention are deemed to be covered by the invention which is limited only by the claims which follow.

I claim:

1. A bath and shower support system comprising first grab bar means, lower support means, upper means, motion inhibiting means, and bonding means, wherein said first grab bar means comprises:

a first grab bar having a round tubular section;

coupling and bracket means comprising:

an L-shaped bracket having a longitudinal and a transverse segment, male and female threads, and containing motion inhibiting means for preventing rotation and translation of said grab bar;

sleeve brackets having access openings in circumferential walls;

a coupling having a longitudinal segment encircling said first grab bar and an open, rotatable transverse segment, wherein said segments connect to each other to provide for angular rotation of an upper grab bar;

a T-shaped bracket having a longitudinal segment with a through opening and a transverse segment with internal threaded means; and a closure fitting on an extremity of said first grab bar;

first connection means comprising:

a suction cup with threaded means;

a cover with an opening formed as a frustrum of a cone; and first locking means comprising a circular sleeve having internal threads; and second connection means comprising:

a second suction cup with a threaded stud;

a second cover with an opening formed as a frustrum of a cone; and second locking means comprising a circular sleeve having a cam integral with a circumference of said sleeve;

wherein said lower support means comprises:

a first lower support section having a tubular section;

a second lower support section having a second tubular section;

rotatable means comprising threaded means contained in said first lower support section for mating with compatible threads contained in said second lower support section; and non-slip means;

wherein said upper means comprises:

a first upper section having a tubular section rotatable in a second upper section;

said second upper section having a tubular section encircling said first upper section; and rotatable means comprising threaded means contained in said first upper section for mating with compatible threads contained in said second upper section;

wherein said first grab bar connects to said lower support means through said sleeve brackets encircling said first grab bar; said access openings in said sleeve brackets containing upper extremities of said lower support means having rotatable means cooperating to support and vertically adjust a height of said first grab bar;

wherein said first grab has an extremity engaging said longitudinal segment of said L-shaped bracket; said transverse segment of said L-shaped bracket engages said first connection means; said longitudinal segment of said T-shaped bracket encircles a portion of said first grab bar; said extremity of said first grab bar extends beyond said longitudinal segment of said T-shaped bracket; said transverse segment of said T-shaped bracket contains said second connection means; said second connection means in combination with said T-shaped bracket have translation along said longitudinal axis of said first grab bar such that said translation provides length adjustment of said first grab bar between said first and second connection means; said first and second locking means rotate on said transverse segments of said L-shaped bracket and said T-bracket;

wherein a circumferential force is applied to covers installed over said suction cups for clamping said suction cups to a tiled wall;

wherein said first upper section of said upper means engages said first grab bar through said coupling; said second upper section of said upper means connects to said first upper section through said rotatable means; said second upper section of said upper means engages said longitudinal segment of said L-shaped bracket; said transverse segment of said L-shaped bracket engages said first connection means; said first locking means of said first connection means rotates on said transverse segment of said L-shaped bracket;

wherein a circumferential force is applied to covers installed over said second suction cups for clamping said suction cup to said tiled wall;

wherein said bonding means is applied to a suction cup face and a wall tile as an adhesive;

and wherein said T-shaped bracket and said second locking means are mutually interchangeable with said L-shaped bracket and said first locking means.

2. A bath and shower support system comprising grab bar means, lower support means, upper support means, and bonding means, wherein said grab bar means comprises:

a grab bar comprising a fixed section and a movable section each comprising a round tubular shape having a transverse segment with internal threaded means integrally formed on one extremity of each of said tubular sections such that said movable section translates within an interior of said fixed section;

coupling and bracket means comprising:

a transverse segment integral with each of said fixed and movable sections of said grab bar, each transverse segment having internal threaded means, sleeve brackets having access opening integral with circumferential walls, and a coupling having a longitudinal segment encircling said grab bar and an open, rotatable transverse segment, wherein said segments rotatably connect to provide for angular rotation of an upper grab bar;

connection means comprising:

a suction cup with threaded means, a cover with an opening formed as the frustrum of a cone, and locking means comprising a circular sleeve having a cam formed on a circumference of said sleeve;

wherein said lower support means comprises:

a first lower support section having a tubular section, a second lower support section having a tubular section, rotatable means comprising threaded means contained in said first lower section for mating with compatible threads contained in said second lower section for permitting said first lower section to rotate and translate axially within said second lower section, and non-slip bearing means;

wherein said upper means comprises:

a first upper section having a tubular section rotatable on an interior surface of a second upper section, said second upper section having a tubular section partially enclosing said first upper section, and rotatable means comprising:

threaded means contained in said first upper section for mating with compatible threads contained in said second upper section for permitting said first upper section to rotate and translate axially within said second upper section for adjusting an overall length of said first and second upper sections;

wherein said fixed section and movable section are connectable to lower support means through said sleeve brackets, said sleeve brackets receive upper extremities of said lower support means through said access openings;

wherein rotatable means of said lower support means assist in supporting said grab bar on a support base and provide adjustment to a vertical height of said grab bar above said support base;

wherein said fixed and movable sections engage said connection means through said integral transverse segment on one extremity such that said locking means of said connection means rotate on said transverse segment for generating circumferential force on said cover and suction cup for clamping said cup onto a tiled wall;

wherein said first upper section of said upper means engages said grab bar through said coupling, said first upper section of said upper means connects with said second upper section through said rotatable means such that an extremity of said second upper section engages said longitudinal segment of an L-shaped bracket, wherein a transverse segment of said L-shaped bracket engages said connection means; and wherein said bonding means is applied to a face of said suction cup and wall tile as an adhesive.

* * * * *